United States Patent [19]

Jundt et al.

[11] Patent Number: 4,492,205

[45] Date of Patent: Jan. 8, 1985

[54] METHOD OF CONTROLLING THE AIR-FUEL RATIO IN AN INTERNAL COMBUSTION ENGINE

[76] Inventors: Werner Jundt, Belschnerstrasse 24, D-7140 Ludwigsburg; Rolf Reischl, Linzerstrasse 44, D-7000 Stuttgart 30, both of Fed. Rep. of Germany

[21] Appl. No.: 434,181

[22] Filed: Oct. 14, 1982

[30] Foreign Application Priority Data

Dec. 11, 1981 [DE] Fed. Rep. of Germany ..... 3149136

[51] Int. Cl.[3] ..... F02M 51/00

[52] U.S. Cl. ..... 123/489; 123/440

[58] Field of Search ..... 123/440, 489, 479

[56] References Cited

U.S. PATENT DOCUMENTS

| | | | |
|---|---|---|---|
| 4,140,085 | 2/1979 | Rabus et al. | 123/489 |
| 4,167,925 | 9/1979 | Hosaka et al. | 123/489 |
| 4,172,432 | 10/1979 | Wessel et al. | 123/440 |
| 4,208,993 | 6/1980 | Peter | 123/489 |
| 4,244,340 | 1/1981 | Herth et al. | 123/489 |
| 4,263,652 | 4/1981 | Henrich | 123/440 |
| 4,345,562 | 8/1982 | Drews et al. | 123/489 |
| 4,393,841 | 7/1983 | Drews et al. | 123/489 |

*Primary Examiner*—Parshotam S. Lall

[57] ABSTRACT

To prevent stumbling operation of an internal combustion (IC) engine (E) during warm-up due to switching back-and-forth between control of the air-fuel composition of the mixture being applied to the engine based on a preset, rich mixture and controlled by a lambda sensor, the lambda sensor internal resistance is sensed and, when the internal resistance of the lambda sensor, when exposed to a rich mixture, is substantially less than when exposed to a fuel-lean mixture, an indication is thereby provided that the sensor has reached proper operating temperatures - see FIG. 3 - is capable of providing output voltages within the evaluation range of two threshold circuits (9, 10) which receive reference values from a voltage divider (6, 7, 8) and of resuming control based on the output voltages of the sensor. The minimum operating temperatures of the sensor are asymmetrical, with respect to lean or rich air-fuel mixtures being applied to the engine, to permit either uninterrupted control of the engine in accordance with a preset air-fuel mixture during warm-up or only by the sensor, after it has reached its operating temperature, thereby preventing back-and-forth switching between control based on the preset conditions and on output signals from the sensor.

8 Claims, 3 Drawing Figures

METHOD OF CONTROLLING THE AIR-FUEL RATIO IN AN INTERNAL COMBUSTION ENGINE

Reference to the state of technology: German Patent Disclosure Document DE-OS No. 27 07 383 corresponding to U.S. Pat. No. 4,208,993, PETER, June 24, 1980.

The present invention relates to a method to control the air-fuel ratio in an internal combustion engine by utilizing a lambda sensor exposed to the exhaust gases of the internal combustion engine, and more particularly to a method to control the air-fuel ratio upon starting the engine when it is cold, and when the sensor also is still cold.

BACKGROUND

Exhaust gas sensors which exhibit voltage jumps upon change of the exhaust gases between reducing and oxidizing condition, customarily known as lambda sensors, are employed in various types of internal combustion engine systems to control the air-fuel ratio of the mixture being supplied to the internal combustion engine such that combustion will occur under optimum conditions and with a minimum of noxious exhaust gases. A control system of this type uses a comparator to determine if the output signal from the sensor is greater or less than a median voltage level (see German Patent Disclosure Document DE-OS No. 27 07 383 corresponding to U.S. Pat. No. 4,208,993, PETER, June 24, 1980). This intermediate or median voltage level forms a reference or control point, and which is set to be within the voltage jump of the output signal of the lambda sensor at the transition between oxidizing and reducing state of the exhaust gases, that is, at an air-fuel ratio at lambda$=\lambda_o$. The control device which determines whether the mixture supplied to the engine should be changed in lean or rich direction responds to the output value from the comparator.

The actual voltage output levels which are compared with the set point provides an indication if the lambda sensor functions under operative conditions. The temperature at which operating condition is sensed is the same whether the supply of the air-fuel ratio is in the rich or in the lean range.

It has been found that such an arrangement is subject to repetitive connection and disconnection of the control system if the lambda sensor is not yet at its appropriate operating temperature. Prompt function of the air-fuel control system is, however, desirable. If the internal combustion engine, immediately after starting and as it is warming up, is operated under idling condition, the control system may be connected and disconnected repeatedly. This results in stumbling operation of the engine, with erratic recovery and, in general, uneven engine operation.

THE INVENTION

It is an object to so operate an air-fuel control system that stumbling operation, upon warming-up of the engine, is essentially prevented.

The invention is based on the discovery that the lambda sensor reacts differentially to exposure to oxidizing and reducing conditions, respectively, in the exhaust gases, representative of lean or rich mixtures being fed to the engine; and that engine stumbling can be avoided if the air-fuel ratio control system is so arranged that the lambda sensor will not affact the air-fuel control until it has reached its appropriate operating temperature so that, until the lambda sensor is ready to provide a control, previously commanded control parameters can be used to determine engine operation, independently of the lambda sensor.

In accordance with a feature of the invention, the internal resistance of the lambda sensor is sensed when a rich mixture is supplied to the engine, for example in accordance with a predetermined preset arrangement. Mixture control under command of the lambda sensor is permitted to occur only if the internal resistance of the lambda sensor has reached a predetermined value which indicates that the temperature or operating state of the lambda sensor such that it will respond properly to changes of exhaust gas between oxidizing and reducing state, rather than providing suitable output signals only when exposed to rich mixtures, and thereby failing to function properly in the control system.

The method of so operating the system to control the air-fuel ratio has the advantage that the control system which controls operation of the engine during warm-up is continued in operation, and the air-fuel control based on the lambda sensor is connected only when the lambda sensor and hence the engine have reached an operating temperature in which the lambda sensor control will be continuously maintained.

In accordance with a feature of the invention, the asymmetrical resistance characteristics of the lambda sensor with respect to response to lean mixtures and rich mixtures, respectively, is prevented from affecting the air-fuel control system, but the sensing of the resistance of the lambda sensor permits transfer of control of the air-fuel ratio to the lambda sensor control as soon as the resistance is appropriate for proper operation of the lambda sensor. Thus, proper operating conditions of the engine will pertain both immediately after starting, during warm-up, and as soon as the lambda sensor has reached the requisite operating temperature to take over air-fuel control.

DRAWINGS

The present invention is based on the system described in the referenced German Patent Disclosure Document DE-OS No. 27 07 383 corresponding to U.S. Pat. No. 4,208,993, PETER, June 24, 1980, which represents a state of techology now well known and in actual use in automotive vehicles. The basic component in this system is a lambda sensor 1, of well known construction, which is exposed to the exhaust gases of an internal combustion engine E, as schematically shown by arrows A. The lambda sensor 1 utilizes a solid electrolyte body, for example zirconium dioxide, which has electrodes applied to opposite surfaces of the zirconium dioxide body. In accordance with a method of operation such a sensor, one side of the zirconium dioxide body is exposed to a reference medium, for example ambient air, forming a reference oxygen level; the other side is exposed to the exhaust gases. Due to the pressure differentials of oxygen partial pressure at the two sides of the solid electrolyte body, a voltage difference will arise at the electrodes. The output voltage of the lambda sensor changes abruptly upon change of the air number lambda=$\lambda_o$. At air numbers of lambda smaller than $\lambda_o$, typically at air numbers of lambda less than 1, or unity, the output voltage across the lambda sensor will have values in the order of between 750 to 900 mV. If the lambda sensor is exposed to lean exhaust gases, however, that is, a value of lambda greater than one or unity, the output voltage is about 100 mV. The foregoing values are based on the lambda sensor being at a temperature suitable for its ordinary operation, that is, at a temperature above generally 350° C. The air-fuel control system, controlled by the output of the lambda sensor, is based on these voltage values, that is, on the lambda sensor being at operating temperature.

Figure 1:
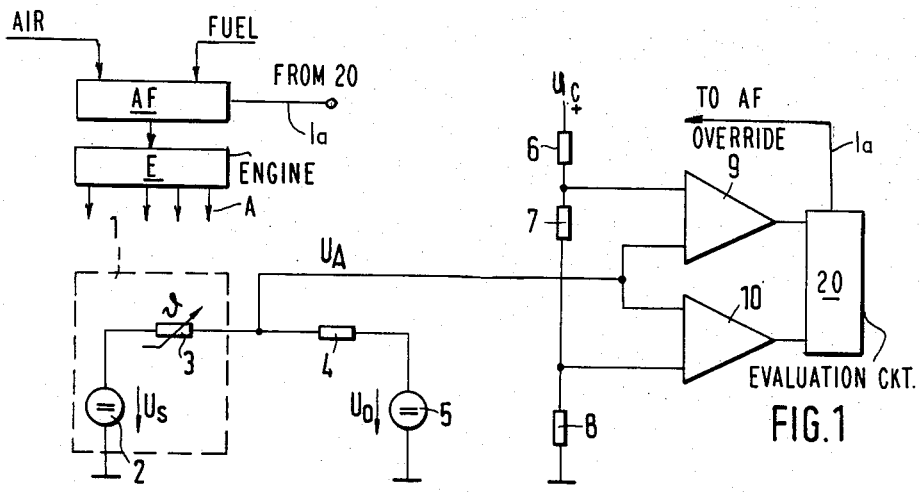
FIG. 1 is a schematic block diagram illustrating the system which uses the method in accordance with the present invention.

The lambda sensor has a disadvantage; when cold, the inner resistance of the sensor can be extremely high so that, at the output of the lambda sensor, no suitable voltage signal, and particularly no clearly definable voltage jump or abrupt change can be obtained. FIG. 1 illustrates the equivalent circuit of the lambda sensor 1, consisting of a voltage source 2 and the temperature-dependent inner or inherent resistance 3. The lambda sensor, as noted, is placed within the exhaust system of the internal combustion (IC) engine E. The engine E has an air-fuel ratio controller AF, for example a carburetor, a fuel injection system, or the like, which supplies an air-fuel mixture to the IC engine, for combustion within the cylinders thereof. The relationship of air to fuel, or the air-fuel ratio, can be predetermined, or preset, in the air-fuel controller AF; additionally, the setting can be changed, or controlled under influence of a control system.

Minimum noxious exhaust gases from the IC engine E will occur if the exhaust gases are representative of stoichiometric combustion. To provide for operation of the engine under such optimum conditions, it is desirable that the air-fuel ratio of the mixture being supplied to the engine be controlled for minimum polluting components as soon as possible after starting of the engine. The system of FIG. 1, which has been published in the aforementioned referenced German Patent Disclosure Document DE-OS No. 27 07 383 corresponding to U.S. Pat. No. 4,208,993, PETER, June 24, 1980, recognizes if the output signal from the lambda sensor 1 is suitable for control use, considering reliability and assurance that the signal truly comes from the sensor and is not a noise or disturbance signal. The circuit is so arranged that the output voltage of the sensor is checked by threshold circuits, since it has been found that the output voltages of the sensor provide a measure of the inner or inherent resistance of the sensor. If the output of the sensor exceeds the threshold levels set by the threshold circuits, signals are generated thereby which provide for supervisory air-fuel control based on the output voltage of the sensor, rather than supply of a preset air-fuel mixture without considering the actual composition of the exhaust gases.

A portion of the circuit is shown in FIG. 1. The lambda sensor 1, represented as a voltage source and a temperature-dependent resistor, provides an output voltage which is fed against a fixed voltage source 5, serially connected with a coupling resistor 4. A voltage $U_A$ is derived from the junction between the lambda sensor and the resistor 4, applied to the inputs of two threshold circuits 9, 10, respectively. The threshold circuits provide different threshold levels, determined by tapping reference voltages from suitable taps or junctions of a voltage divider formed by resistors 6, 7, 8 and connected across a source of stabilized reference potential, the positive terminal being connected to resistor 6 and ground or chassis, or the negative terminal being connected to resistor 8. A signal is applied to the threshold amplifier 9, tapped between the resistors 6 and 7, which determines the upper threshold response level; a further signal is derived between the resistors 7 and 8, which determines the lower threshold response level. The output signals of the threshold circuits are connected to an evaluation unit 20 which provides an override output signal to the air-fuel controller AF, so that the air-fuel ratio of the mixture being applied to the engine E will be under control of the output signal $U_A$ derived from the lambda sensor.

Figure 2:
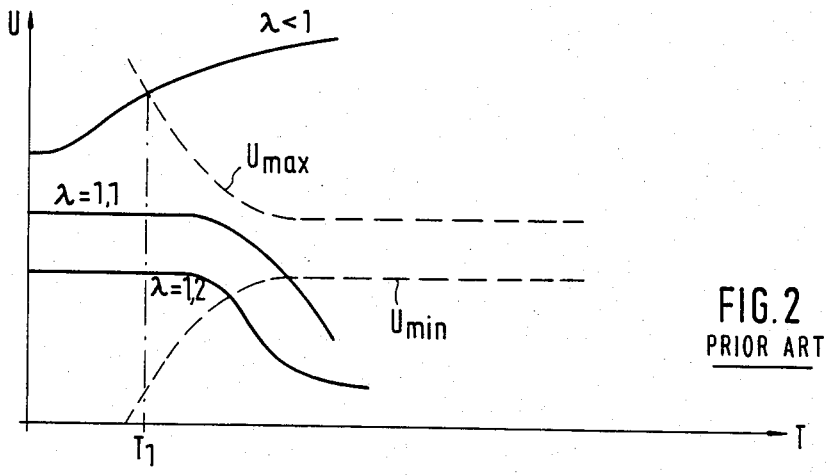
FIG.2 PRIOR ART
FIG. 2 is a graph of operation of the lambda sensor in accordance with the prior art.
Figure 3:
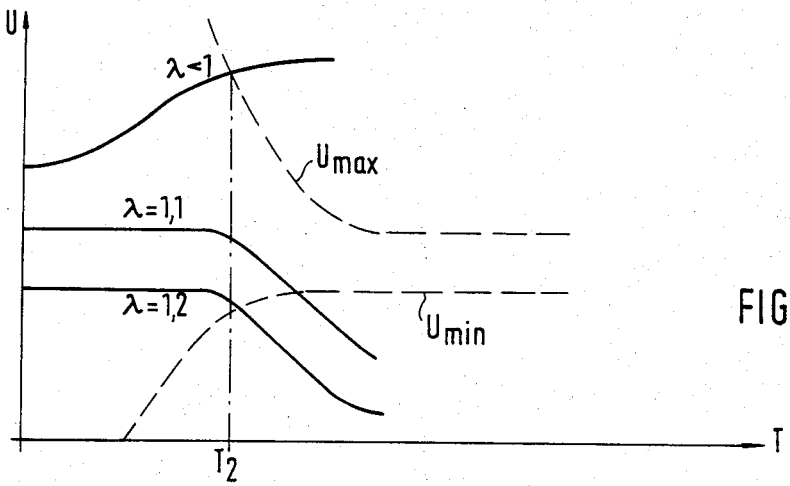
FIG. 3 is a graph illustrating the operation in accordance with the method of the present invention.

FIGS. 2 and 3 illustrate the operating characteristics of the circuit arrangement in accordance with FIG. 1. The voltage $U_S$ of the equivalent voltage source 2 of the lambda sensor, which is necessary in order to reach the lower threshold level determined by the lower level threshold circuit 10, is the effective switching threshold $U_{min}$. The sensor voltage $U_S$, which is necessary to reach the upper threshold level determined by the threshold amplifier 9, is the maximum threshold voltage $U_{max}$. The curves for $U_{max}$ and $U_{min}$, with change in temperature, are shown as broken lines in FIGS. 2 and 3. Voltages from the sensor, with respect to temperature, for various values of lambda, are shown as follows: $\lambda<1$, that is, a rich mixture, is represented by the upper solid line; $\lambda=1.1$ is represented by the center solid line; and $\lambda=1.2$, that is, a very lean mixture, is represented by the lower solid line.

OPERATION ACCORDING TO PRIOR ART

As the sensor warms up, and before it has reached operating temperature, the following operation of the circuit of FIG. 1 will occur:

If the temperature is less than the temperature $T_1$, the sensor voltage $U_S$ will never reach the level $U_{min}$ nor the level $U_{max}$. Thus, since neither one of the threshold circuits 9, 10 can respond, and after elapse of an initial period, the air-fuel controller AF is set to its predetermined air-fuel ratio value. Customarily, and typically, the exhaust gas is usually rich during warm-up, corresponding to $\lambda<1$ or unity. When the temperature $T_1$ is reached, the threshold level $U_{max}$ is exceeded, and the usual proportional-integral (PI) controller included in the AF controller is changed to control the air-fuel ratio in accordance with the output from the lambda sensor, that is, in accordance with the signal derived from output line 1*a*. Since the lambda sensor will indicate that the exhaust gas mixture is based on a rich air-fuel ratio, the AF controller will change the proportion of air and fuel in a lean direction. The exhaust gas composition will then shift down through the curve $\lambda=1.1$ and will reach the $\lambda=1.2$ curve. As can be clearly seen from FIG. 2, the output voltage of the sensor 1 cannot reach the level $U_{min}$. Even in the most extreme control range - $\lambda=1.2$- the threshold $U_{min}$ will not be reached. In accordance with preset control of the AF controller, thus, that is, upon failure of receiving an output control signal from line 1*a*, a timing circuit therein disconnects the control based on an output signal from line 1*a* and changes the AF controller over to the preset value. This is a safety feature in case of failure of the lambda sensor or circuitry or connecting lines associated therewith. As soon as the preset air-fuel mixture composition is again set into the AF controller, the mixture will change abruptly to rich, and, after the usual delay time due to operation of the controller, combustion in the engine, and passage of the gases to the exhaust sensor, the lambda sensor will again recognize an exhaust condition $\lambda<1$, which provides a useful output signal from threshold circuit 9, causing the AF controller to resume active control of the air-fuel ratio which, however, cannot continue because the minimum voltage level will not be reached. The continuous change in the composition of the air-fuel mixture being supplied to the engine leads to rough and stumbling operation of the engine and undesirable operation thereof.

OPERATION ACCORDING TO THE PRESENT INVENTION:

The system is operated such that control by the lambda sensor 1 is established only when the lambda sensor 1 is in operating condition; and, additionally, the system is so controlled and so arranged that control by the sensor will be assumed as soon as the sensor is capable of providing appropriate output signals in both directions. Thus, the command taken by the sensor will not be fixed by a certain time interval, but rather by the characteristics and operating conditions of the sensor itself.

FIG. 3 again illustrates the respective operating curves of the sensor, and the voltage curves with respect to different air-fuel ratios.

In accordance with a feature of the invention, the voltage $U_O$ of the voltage source 5 and the resistor 4 are constant. The value of the voltage $U_O$ is placed to fall between the threshold levels of the threshold amplifiers 9, 10. The sensor output voltage $U_S$, of course, is a function of temperature and of exhaust gas composition. The internal or inherent resistance of the sensor, represented by resistor 3 in the equivalent circuit diagram, is temperature-dependent.

In accordance with the present invention, preset control by the AF controller is made dependent only on the level of the output voltage $U_A$ with respect to the lower threshold level $U_{min}$. As can be seen from FIG. 3, if the upper threshold level $U_{max}$ is exceeded, or if the sensor voltage is between $U_{max}$ and $U_{min}$, the air-fuel controller AF will change the composition of the supplied mixture in the lean direction. In addition, upon change from $U_{max}$ to $U_{min}$, a timing interval is started which, as discussed above, causes the AF controller to switch over to its preset level unless the AF controller receives a reversing signal earlier from the threshold 10. Under sensor control operation, however, the air-fuel mixture ratio is controlled towards a richer range only if the output voltage $U_A$ passes below the lower threshold level.

Without changing the control characteristics, thus, it is possible to shift the upper threshold voltage $U_{max}$, to which the circuit will respond, such that the controller will operate under control of the signal from line 1*a* only at a higher temperature, by so aranging the system that the controller AF will respond only if a signal is received from the threshold circuit 9. Operating the IC engine with a rich mixture in the warm-up phase, that is, $\lambda<1$ or unity, $U_{max}$ will then be reached only at a temperature $T_2$. At the temperature $T_2$, the controller AF is enabled, and will then control the air-fuel mixture compostion in a lean direction. The AF controller will then respond to the leanest position, at $\lambda=1.2$ at a time when the sensor has warmed up to such an extent that, even at $\lambda=1.2$, the threshold level of the comparator 10 can be passed, so that the controller AF can then again change the mixture into a richer range. Transfer of control from the sensor, however, to the override set into the unit AF is avoided, and the stumbling and recovering operation of the engine upon warm-up is prevented. The controller, thus, will be immediately operative based on actual sensed exhaust as soon as the sensor is capable of providing the appropriate output signals; repetitive switching back-and-forth between control from the sensor and inherent control of the air-fuel controller AF, resulting in stumbling engine operation, is eliminated.

In actual use, the input circuit of the sensor 1, resistor 4, and voltage source 5 are suitably matched based on the following considerations: The switch-ON resistance upon sensing a rich mixture is the internal resistance of the sensor, as represented by resistor 3. This resistance is to be determined at a switching threshold $U_{max}$ of 0.8 V. The lean switch-ON resistance is the sensor resistance at an effective switching level at which the voltage $U_{min}$ is 0.1 V. In accordance with the prior art, the internal sensor resistance for rich and lean mixtures, respectively, was determined to be equal and was in the range of between 1 to 2 meg ohms.

In accordance with the present invention, the input circuit of the sensor is changed by changing the dimensioning of the input resistances. The effective sensor resistance when responding to a rich mixture will change to be, for example, in the range of between 100–200 kilo ohms, thereby changing the switching voltage $U_{max}$ in a direction of a higher temperature range. The lower threshold level voltage $U_{min}$ can continue to use the lean switching-ON internal resistance in its original form, that is, from between 1 to 2 meg ohms. The curves $U_{max}$ and $U_{min}$ of FIG. 3 illustrate this changed relationship, where it will be seen that $U_{min}$ of FIG. 3 corresponds to $U_{min}$ of FIG. 2.

Assuming a reference voltage connected across the voltage dividers 6, 7, 8 of $U_c=5{,}55$ V, the resistor had the following values:

resistor 6: 61,13 kΩ
resistor 7: 1,682 kΩ
resistor 8: 5,557 kΩ
threshold level at junction resistors 6/7: 0.591 V
threshold level at junction resistors $\frac{7}{8}$: 0.444 V
voltage of source 5: 0.474 V
resistor 4: 73.69 kΩ

The internal resistance of the sensor 1, as measured by balancing the output voltage against the source 5, and comparing with the voltages at the voltage divider tap points, when the sensor is exposed to an oxygen-deficient mixture, corresponding to an air-fuel ratio of $\lambda<1$, or unity, i.e. a rich mixture, preferably is not more than half, and preferably about 10% of the internal resistance of the sensor when exposed to an oxygen-rich mixture, for example $\lambda=1.2$, to permit the comparators and the evaluation circuit 20 to respond at temperature $T_2$, as illustrated in FIG. 3.

We claim:

1. Method of controlling operation of an air-fuel ratio control system for an internal combustion engine (E), having a lambda sensor (1) exposed to the exhaust gases of the engine, means (4,5) for monitoring operating readiness of the sensor including a d-c reference voltage ($U_o$) source (5) and a coupling resistor (4) serially connected therewith and with the lambda sensor (1) and a resistance sensing means for evaluating the internal resistance of the sensor, the reference voltage being connected to be polarized opposite to the polarity of the output voltage of the lambda sensor;

threshold means (6, 7, 8, 9, 10) including two comparators (9, 10) each having an output signal state, being connected to the lambda sensor, and connected to respond respectively to upper ($U_{max}$) and lower ($U_{min}$) threshold voltage levels, each voltage taking on values respectively above and below the voltage ($U_o$) of said reference source, and hence evaluating the voltage jump between said values upon change of oxygen content of the exhaust gases from the engine, said threshold means further comprising resistances (6, 7, 8) which determine said threshold voltages, and air-fuel control means (20, AF) controlling the air-fuel ratio, of the air-fuel mixture being supplied to the engine, selectively, in accordance with signals derived from said lambda sensor, when said sensor is in condition to maintain a minimum threshold voltage signal output, or in accordance with a preset ratio, when said sensor fails to maintain said threshold voltage output, said method comprising, in accordance with the invention, the steps of feeding the outputs of said sensor and said reference voltage source to a junction, applying the output signal from said junction to one of the inputs of each of said comparators (9, 10), selecting said resistances such that said maximum threshold voltage ($U_{max}$) takes on a value not symmetrical to said reference voltage ($U_o$) with respect to the value of said minimum threshold voltage ($U_{min}$), but rather is displaced in the direction of a higher value than the value of said minimum threshold voltage, starting the operation of said engine with said control means (20, AF) controlling the air-fuel mixture in accordance with said preset ratio , upon receipt of signals from said threshold comparators (9, 10) indicating a change in their output state, switching said control means (20, AF) to control in accordance with signals from said comparators (9, 10), and in the absence of signals from said comparators (9, 10) for a predetermined period of time, switching said control means back to control in accordance with said preset ratio.

2. Method according to claim 1, wherein the step of controlling in accordance with signals from said comparators comprises changing the composition of the air-fuel mixture in the lean direction whenever the sensor output voltage ($U_A$) exceeds the lower threshold voltage ($U_{min}$) and changing the composition of the air-fuel mixture toward a richer range whenever the sensor output voltage ($U_A$) drops below the lower threshold voltage.

3. Air-fuel ratio control system for an internal combustion engine (E) including a lambda sensor (1), having a warm-up phase, exposed to the exhaust gases (A) of the engine, and having means (4,5) for monitoring operating readiness of the sensor including a d-c reference voltage ($U_o$) source (5) and a coupling resistor (4), serially connected therewith and with the sensor (1), and connected in a resistance-sensing circuit for evaluating the internal resistance of the lambda sensor, the reference source (5) being connected with its polarity opposite to the polarity of the output voltage ($U_S$) of the lambda sensor, when the lambda sensor is exposed to exhaust gases deficient in oxygen;

threshold means (6,7,8,9,10), including comparators (9) and (10) each having an output signal state, being connected to the lambda sensor, and connected to respond respectively to upper ($U_{max}$) and lower ($U_{min}$) threshold voltage levels respectively above and below the voltage ($U_o$) of said source, said threshold means sensing the voltage jump of the output voltage ($U_S$) from the sensor upon change of oxygen content of the exhaust gases from the engine, and independent air-fuel control means (20, AF) controlling, independently of control by the lambda sensor, the air-fuel ratio of the air-fuel mixture being supplied to the engine, if the resistance of the lambda sensor is outside a predetermined limit, wherein, in accordance with the invention, the threshold means are so arranged and dimensioned that the magnitude of the difference, during the warm-up phase, between the upper threshold voltage ($U_{max}$) and the reference voltage ($U_o$) is greater than the magnitude of the difference between the lower threshold voltage ($U_{min}$) and the reference voltage ($U_o$), so that the comparator (9) changes its output state only when the lambda sensor reaches a temperature ($T_2$) which assures reliable operation at all mixture settings.

4. System according to claim 3, wherein said internal resistance value of the sensor when exposed to exhaust gases deficient in oxygen is less than half of the internal resistance when exposed to exhaust gases rich in oxygen.

5. System according to claim 3, wherein said internal resistance value of the sensor when exposed to exhaust gases deficient in oxygen is about 10% of the internal resistance when exposed to exhaust gases rich in oxygen.

6. System according to claim 3, wherein said threshold voltages are set in such a manner that, at a particular low operating temperature ($T_2$) of the lambda sensor, a first one (9) of said comparators changes its output state whenever a deficiency of oxygen in said exhaust gases indicates that said mixture has reached a maximally rich ratio, and a second one (10) of said comparators changes its output state whenever an excess of oxygen in said exhaust gases indicates that said mixture has reached a maximally lean ratio.

7. System according to claim 6, further comprising a voltage source ($U_c$), a ground, and first, second and third resistances (6,7,8) connected in series between said source and said ground, wherein one input of said first comparator is connected to a junction between said first (6) and second (7) resistances, one input of said second comparator is connected to a junction between said second (7) and third (8) resistances, and said threshold voltages are set by selection of appropriate values of said resistances.

8. System according to claim 7, wherein said voltage source is about 6 volts and the values of said first, second and third resistances are respectively about 61 KOhms, 2 KOhms, and 5.5 KOhms.

* * * * *